US010885817B2

(12) United States Patent
Duncan et al.

(10) Patent No.: US 10,885,817 B2
(45) Date of Patent: Jan. 5, 2021

(54) FLAG DISPLAYING ASSEMBLY

(71) Applicants: Taylor Duncan, Perris, CA (US); Salvador Ruvalcaba, Perris, CA (US)

(72) Inventors: Taylor Duncan, Perris, CA (US); Salvador Ruvalcaba, Perris, CA (US)

( * ) Notice: Subject to any disclaimer, the term of this patent is extended or adjusted under 35 U.S.C. 154(b) by 345 days.

(21) Appl. No.: 15/948,603

(22) Filed: Apr. 9, 2018

(65) Prior Publication Data

US 2019/0311660 A1 Oct. 10, 2019

(51) Int. Cl.
*G09F 17/00* (2006.01)
*E04H 12/32* (2006.01)

(52) U.S. Cl.
CPC ..... *G09F 17/00* (2013.01); *E04H 12/32* (2013.01); *G09F 2017/005* (2013.01); *G09F 2017/0016* (2013.01)

(58) Field of Classification Search
CPC ..... G09F 17/00; G09F 2017/0016; G09F 2017/005; E04H 12/32
See application file for complete search history.

(56) References Cited

U.S. PATENT DOCUMENTS 1,102,270 A * 7/1914 Howard ..... G09F 17/00 40/218
1,660,341 A 2/1928 Lapworth
1,725,250 A 8/1929 Burgess
1,794,873 A * 3/1931 Thoroman ..... E04H 12/32 116/173
2,270,753 A 1/1942 Fikes
2,377,219 A * 5/1945 Ellis ..... G09F 17/00 116/173
2,870,559 A * 1/1959 Shaughnessy ..... E04H 12/32 40/614
3,477,161 A 11/1969 Drexler
5,398,638 A 3/1995 Bonk
5,427,050 A 6/1995 Horn
6,622,649 B1 * 9/2003 Shaw ..... G09F 17/00 116/173
7,017,510 B1 3/2006 Nair
8,621,771 B2 1/2014 Amalaha
9,280,922 B1 3/2016 Chery
10,151,329 B2 * 12/2018 Moore ..... G09F 17/0091

* cited by examiner

*Primary Examiner* — Nimeshkumar D Patel
*Assistant Examiner* — Tania Courson

(57) ABSTRACT

A flag displaying assembly for extending a limp flag includes a pole that is coupled to a surface so that the pole is substantially perpendicular to the surface. The pole is hollow. A plurality of holes is positioned in the pole. The plurality of holes extends linearly from proximate to a top of the pole toward a bottom of the pole. A flag is coupled to the pole proximate to the top. A forced air unit is coupled to the pole proximate to the bottom so that the forced air unit is in fluidic communication with the pole. The forced air unit is positioned to supply air through the pole to the holes. The air that exits the pole through the holes is positioned to extend the flag from the pole.

12 Claims, 3 Drawing Sheets

FLAG DISPLAYING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to displaying assemblies and more particularly pertains to a new displaying assembly for extending a limp flag.

BRIEF SUMMARY OF THE INVENTION

An embodiment of the disclosure meets the needs presented above by generally comprising a pole that is coupled to a surface so that the pole is substantially perpendicular to the surface. The pole is hollow. A plurality of holes is positioned in the pole. The plurality of holes extends linearly from proximate to a top of the pole toward a bottom of the pole. A flag is coupled to the pole proximate to the top. A forced air unit is coupled to the pole proximate to the bottom so that the forced air unit is in fluidic communication with the pole. The forced air unit is positioned to supply air through the pole to the holes. The air that exits the pole through the holes is positioned to extend the flag from the pole.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
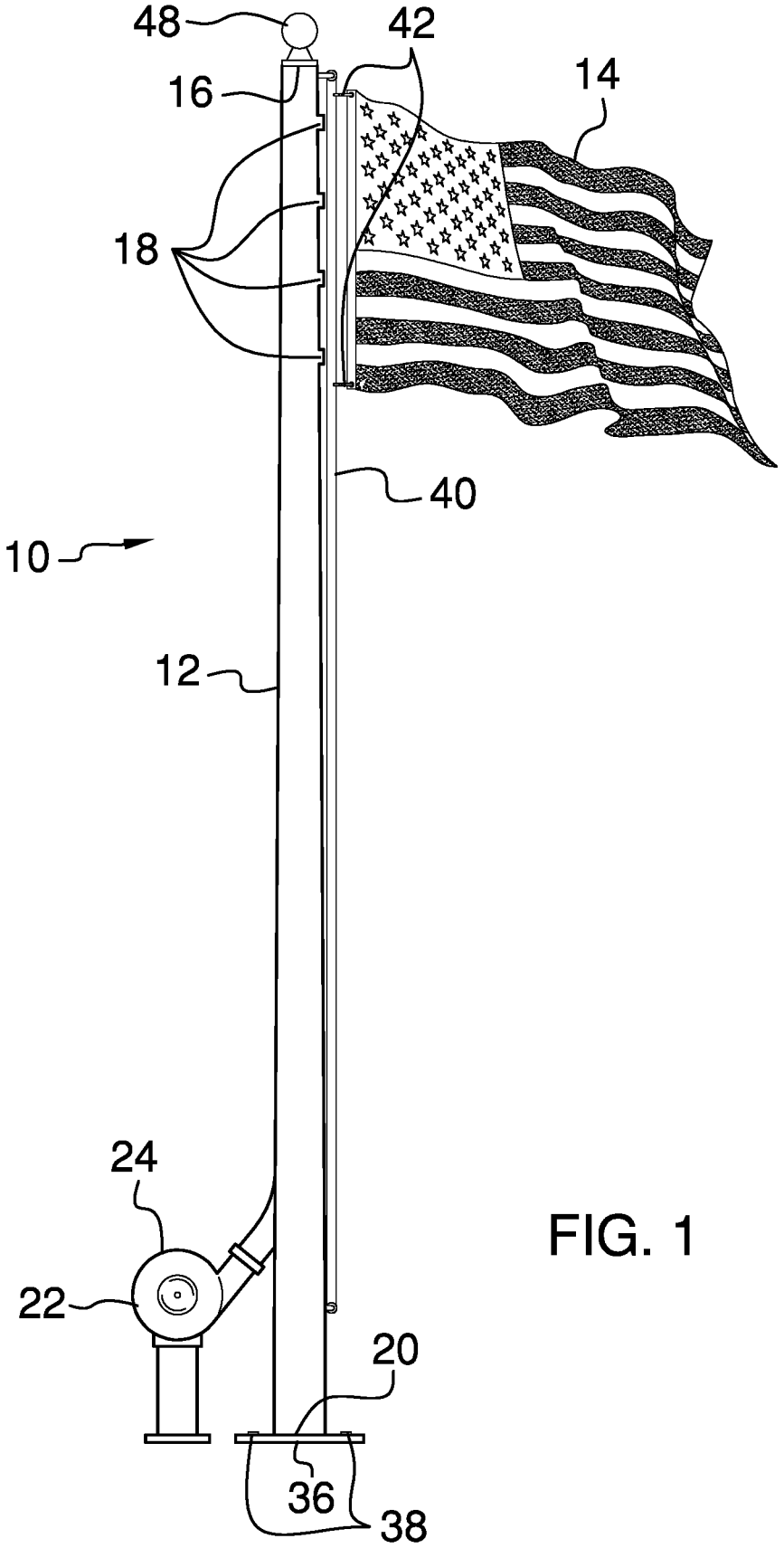
FIG. 1 is an in-use view of a flag displaying assembly according to an embodiment of the disclosure.

With reference now to the drawings, and in particular to FIGS. 1 through 4 thereof, a new displaying assembly embodying the principles and concepts of an embodiment of the disclosure and generally designated by the reference numeral 10 will be described.

As best illustrated in FIGS. 1 through 4, the flag displaying assembly 10 generally comprises a pole 12 that is coupled to a surface so that the pole 12 is substantially perpendicular to the surface, as shown in FIG. 1. The pole 12 is hollow and is circularly shaped when viewed longitudinally. A flag 14 is coupled to the pole 12 proximate to a top 16 of the pole 12.

A plurality of holes 18 is positioned in the pole 12. The plurality of holes 18 comprises four holes 18 that extend linearly from proximate to the top 16 of the pole 12 toward a bottom 20 of the pole 12, as shown in FIG. 2.

A forced air unit 22 is coupled to the pole 12 proximate to the bottom 20. The forced air unit 22 is in fluidic communication with the pole 12. The forced air unit 22 is positioned to supply air through the pole 12 to the holes 18. The air that exits the pole 12 through the holes 18 is positioned to extend the flag 14 from the pole 12. The forced air unit 22 comprises a blower 24, as shown in FIG. 1, an air compressor 26, as shown in FIG. 4, or the like.

Figure 2:
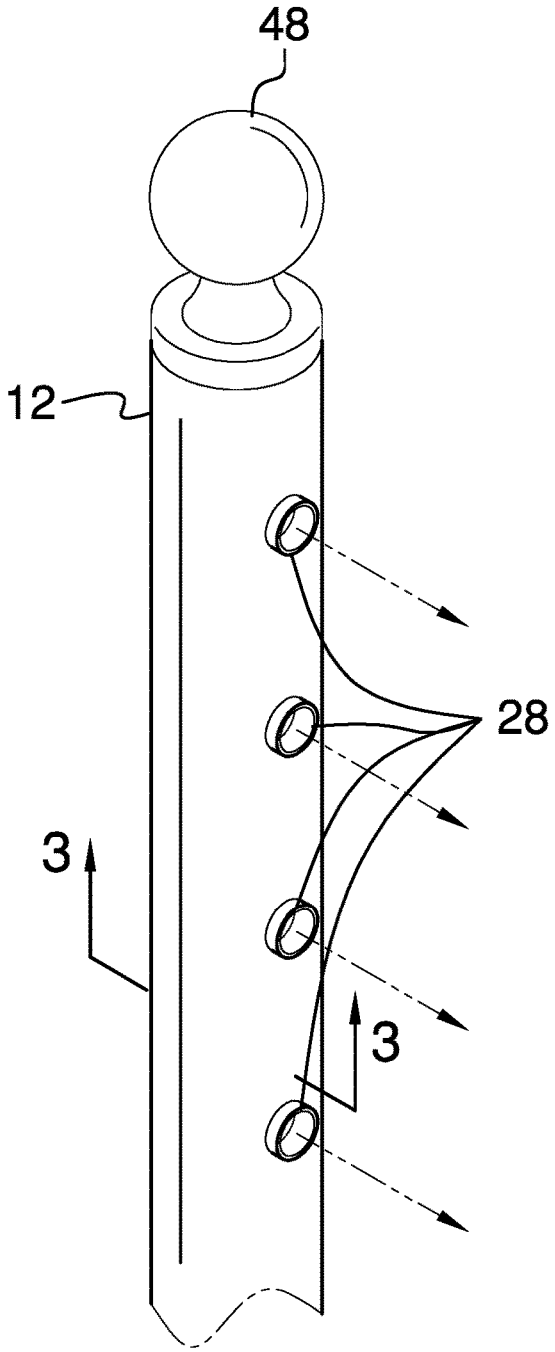
FIG. 2 is an isometric perspective view of an embodiment of the disclosure.

Each of a plurality of nozzles 28 is coupled to the pole 12 and extends from an associated hole 18, as shown in FIG. 2. The nozzles 28 are positioned to direct the air that passes through the holes 18 toward the flag 14.

Figure 3:
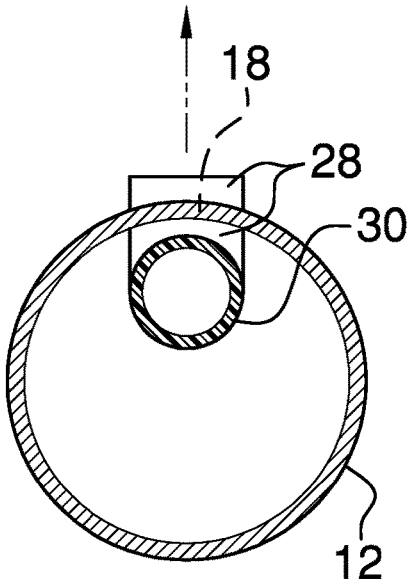
FIG. 3 is a cross-sectional view of an embodiment of the disclosure.
Figure 4:
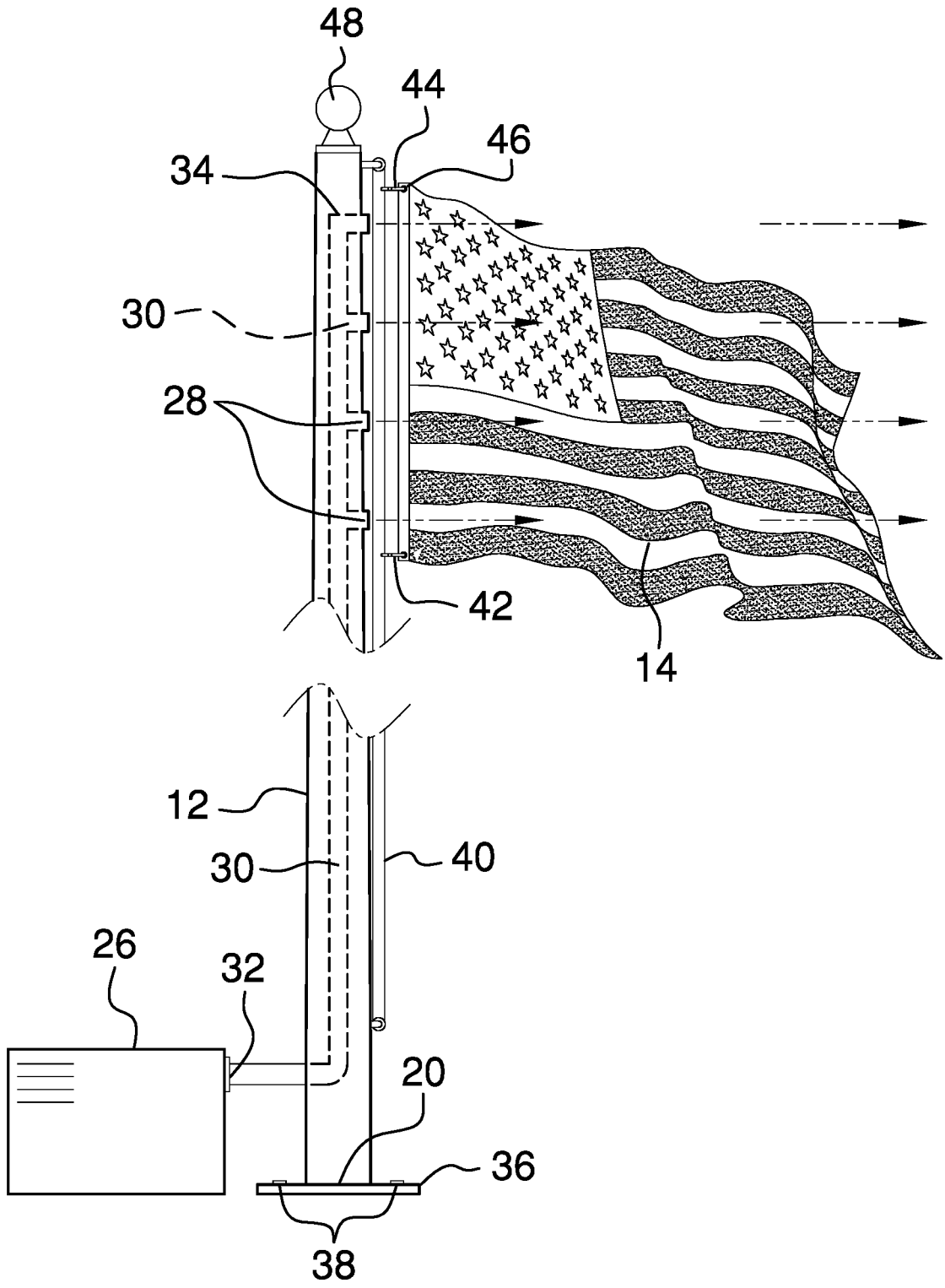
FIG. 4 is an in-use view of an embodiment of the disclosure.

In one embodiment of the invention, as shown in FIGS. 3 and 4, the assembly 10 comprises a tube 30. The tube 30 has a first end 32 that is coupled to the forced air unit 22 so that the tube 30 is in fluidic communication with the forced air unit 22. The tube 30 has a second end 34 that is closed. Each of the nozzles 28 is coupled to the tube 30 and extends from the tube 30 through an associated hole 18, as shown in FIG. 3. The nozzles 28 are in fluidic communication with the tube 30. The forced air unit 22 is positioned to supply the air through the tube 30 to the nozzles 28. The air that exits the tube 30 through the nozzles 28 is positioned to extend the flag 14 from the pole 12, as shown in FIG. 4.

The assembly 10 also comprises a plate 36 that is squarely shaped, as shown in FIG. 1. The pole 12 is coupled to and extends perpendicularly from the plate 36. A plurality of orifices 38 is positioned through the plate 36. Each orifice 38 is positioned to insert a respective item of mounting hardware to couple the plate 36 to a surface.

A halyard 40 is coupled to the pole 12, as shown in FIG. 4. The halyard 40 extends from proximate to the top 16 to proximate to the bottom 20 of the pole 12. A pair of snap hooks 42 is coupled to the halyard 40. Each snap hook 42 is positioned to couple to a respective grommet 44 that is positioned in a respective corner 46 of the flag 14 to couple the flag 14 to the halyard 40. The halyard 40 is positioned to hoist the flag 14.

A finial 48 is coupled to and extends from the top 16 of the pole 12. The finial 48 is ball-type as shown in FIG. 1.

In use, the forced air unit 22 is positioned to supply the air through the tube 30 to the nozzles 28. The air that exits the tube 30 through the nozzles 28 is positioned to extend the flag 14 from the pole 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A flag displaying assembly comprising:

a pole coupled to a surface such that said pole is substantially perpendicular to the surface, said pole being hollow;

a plurality of holes positioned in said pole, said plurality of holes extending linearly from proximate to a top of said pole toward a bottom of said pole, said plurality of holes being in a fixed position relative to said top of said pole and said bottom of said pole;

a flag coupled to said pole proximate to said top;

a forced air unit coupled to said pole proximate to said bottom such that said forced air unit is in fluidic communication with said pole wherein said forced air unit is positioned for supplying air through said pole to said holes such that the air exiting said pole through said holes is positioned for extending said flag from said pole;

a halyard coupled to said pole, said halyard extending from proximate to said top to proximate to said bottom of said pole in a fixed position in alignment parallel with said plurality of holes;

a pair of snap hooks coupled to said halyard; and a pair of grommets, each said grommet being positioned in a respective corner of said flag such that each said snap hook is positioned for coupling to a respective said grommet for coupling said flag to said halyard such that said halyard is positioned for hoisting said flag.

2. The assembly of claim 1, further including said pole being circularly shaped when viewed longitudinally.

3. The assembly of claim 1, further including said plurality of holes comprising four said holes.

4. The assembly of claim 1, further including said forced air unit comprising a blower.

5. The assembly of claim 1, further including said forced air unit comprising an air compressor.

6. The assembly of claim 1, further including a plurality of nozzles, each said nozzle being coupled to said pole and extending from an associated said hole such that said nozzle is positioned for directing the air passing through said associated said hole toward said flag.

7. The assembly of claim 6, further including a tube having a first end coupled to said forced air unit such that said tube is in fluidic communication with said forced air unit, said tube having a second end, said second end being closed, each of said nozzles being coupled to said tube and extending from said tube through an associated said hole such that said nozzles are in fluidic communication with said tube wherein said forced air unit is positioned for supplying the air through said tube to said nozzles such that the air exiting said tube through said nozzles is positioned for extending said flag from said pole.

8. The assembly of claim 1, further comprising:

a plate, said pole coupled to and extending perpendicularly from said plate; and a plurality of orifices positioned through said plate wherein each said orifice is positioned for inserting a respective item of mounting hardware for coupling said plate to a surface.

9. The assembly of claim 8, further including said plate being squarely shaped.

10. The assembly of claim 1, further including a finial coupled to and extending from said top of said pole.

11. The assembly of claim 10, further including said finial being ball-type.

12. A flag displaying assembly comprising:

a pole coupled to a surface such that said pole is substantially perpendicular to the surface, said pole being hollow, said pole being circularly shaped when viewed longitudinally;

a plurality of holes positioned in said pole, said plurality of holes extending linearly from proximate to a top of said pole toward a bottom of said pole, said plurality of holes comprising four said holes;

a flag coupled to said pole proximate to said top;

a forced air unit coupled to said pole proximate to said bottom such that said forced air unit is in fluidic communication with said pole wherein said forced air unit is positioned for supplying air through said pole to said holes such that the air exiting said pole through said holes is positioned for extending said flag from said pole, said forced air unit comprising a blower, said forced air unit comprising an air compressor;

a plurality of nozzles, each said nozzle being coupled to said pole and extending from an associated said hole such that said nozzle is positioned for directing the air passing through said associated said hole toward said flag;

a tube having a first end coupled to said forced air unit such that said tube is in fluidic communication with said forced air unit, said tube having a second end, said second end being closed, each of said nozzles being coupled to said tube and extending from said tube through an associated said hole such that said nozzles are in fluidic communication with said tube wherein said forced air unit is positioned for supplying the air through said tube to said nozzles such that the air exiting said tube through said nozzles is positioned for extending said flag from said pole;

a plate, said pole coupled to and extending perpendicularly from said plate, said plate being squarely shaped;

a plurality of orifices positioned through said plate wherein each said orifice is positioned for inserting a respective item of mounting hardware for coupling said plate to a surface;

a halyard coupled to said pole, said halyard extending from proximate to said top to proximate to said bottom of said pole in a fixed position on said pole in alignment parallel with said plurality of holes;

a pair of snap hooks coupled to said halyard;

a pair of grommets, each said grommet being positioned in a respective corner of said flag such that each said snap hook is positioned for coupling to a respective said grommet for coupling said flag to said halyard such that said halyard is positioned for hoisting said flag;

a finial coupled to and extending from said top of said pole, said finial being ball-type.

* * * * *